US006250468B1

(12) United States Patent
Huchel

(10) Patent No.: US 6,250,468 B1
(45) Date of Patent: Jun. 26, 2001

(54) EASY TO REMOVE OVERWRAP

(75) Inventor: Robert John Huchel, Catlin, IL (US)

(73) Assignee: Teepak Investments, Inc., Wilmington, DE (US)

( * ) Notice: Subject to any disclaimer, the term of this patent is extended or adjusted under 35 U.S.C. 154(b) by 0 days.

(21) Appl. No.: 09/248,090

(22) Filed: Feb. 10, 1999

(51) Int. Cl.[7] ..... B65D 35/24

(52) U.S. Cl. ..... 206/446; 53/434; 53/473; 206/497; 206/524.8; 206/802; 229/87.05

(58) Field of Search ..... 138/118.1; 206/443, 206/446, 497, 802, 524.8; 229/87.05; 383/204–207, 209; 452/21, 22; 53/403, 434, 469, 473

(56) References Cited

U.S. PATENT DOCUMENTS

| | | | | |
|---|---|---|---|---|
| 3,528,825 | * | 9/1970 | Doughty | 206/802 |
| 3,616,990 | * | 11/1971 | Powell | 383/209 |
| 3,618,850 | * | 11/1971 | Palmer | 383/204 |
| 3,639,130 | | 2/1972 | Eichin et al. | 99/175 |
| 3,764,351 | | 10/1973 | Whittington et al. | 206/46 |
| 3,971,187 | * | 7/1976 | McNeill et al. | 206/802 |
| 4,986,673 | * | 1/1991 | Bell | 383/204 |
| 5,356,007 | | 10/1994 | Feldt | 206/443 |
| 5,381,643 | | 1/1995 | Kazaitis et al. | 53/415 |
| 5,382,190 | | 1/1995 | Graves | 452/21 |
| 5,391,108 | | 2/1995 | Feldt | 452/21 |
| 5,409,115 | * | 4/1995 | Barkhorn | 229/87.05 |
| 5,727,364 | | 3/1998 | Artieda | 53/415 |
| 5,893,460 | * | 4/1999 | Castro et al. | 383/207 |
| 5,939,156 | | 8/1999 | Rossi et al. | 428/34.8 |
| 5,955,126 | * | 9/1999 | Jon et al. | 426/105 |

FOREIGN PATENT DOCUMENTS

| | | |
|---|---|---|
| 1256072 | 6/1989 | (CA) . |
| 0 696 542 | 2/1996 | (EP) . |
| 1 469 614 | 4/1977 | (GB) . |

* cited by examiner

*Primary Examiner*—Jim Foster
(74) *Attorney, Agent, or Firm*—Michael L. Dunn

(57) ABSTRACT

A tubular film package comprising a tubular film provided with a tear strip secured upon an outside surface of the film. The tear strip is defined by a longitudinal edge of the film and a heat seal joint provided in the film essentially parallel to the longitudinal edge. The film is further provided with at least one slit running from an end of the film to the heat seal line so that pulling of the strip away from the package commencing at the slit causes film to separate proximate the heat seal line thus opening the package.

10 Claims, 1 Drawing Sheet

EASY TO REMOVE OVERWRAP

BACKGROUND OF THE INVENTION

This invention relates to packages for food casing strands.

Food casing strands are shirred tubular film food casing. "Shirred" means radially folded so as to be compressed along the longitudinal axis of the tubular film.

Such shirred food casings are packages for storage and shipment to food processors, e.g. meat packers making cylindrically shaped sausage product.

Numerous types of packages for shirred food casing have been used in the prior art. Such packages have included rigid cartons as well as net and film wrappings.

Film wrappings have had certain advantages, e.g. they are light weight and usually provide a moisture barrier to prevent dehydration of moisturized strand products.

One difficulty with film packages for food casing strands has been that a film which is strong enough to provide a secure package is generally difficult to remove from the packaged product.

This problem has been addressed by providing adhesive opening strips or areas which can be readily removed to provide access to package contents.

Unfortunately such adhesive strips have caused yet another problem in that after removal they tend to stick to undesirable areas creating disorganization and a generally messy environment.

In another known film packaging system, tape is provided along the length of the package and perforations or other weakened areas are provided along the edges of the tape so that a portion of packaging film is removed with the tape. The adhesive portion of the tape is thus covered by removed film which prevents problems associated with sticky removed tape. Such a package still has some disadvantages in that the film must be processed to provide weakened areas and there is a cost associated with the use of adhesive tape.

In essentially all cases in the prior art, at least one end of a package for a shirred casing strand must be opened before the strand can be placed on a stuffing horn to fill the casing with food product. Opening the package holding a strand, especially of fibrous casing, creates a risk that the strand will break along a helical fold thus making it very difficult or even impossible to load onto the stuffing horn. Furthermore, opening a package containing a strand of food casing before placement on a stuffing horn creates an increased risk of contamination.

None of the prior packages for food casing strands permit placement of the strand within a sealed package on a stuffing horn without opening the package while permitting easy removal of the packaging material while the stand remains on the stuffing horn.

It is therefore an object of the invention to provide a readily openable film package for food casing strands which overcomes the previously described disadvantages of prior art film packages.

BRIEF DESCRIPTION OF THE INVENTION

Figure 1:
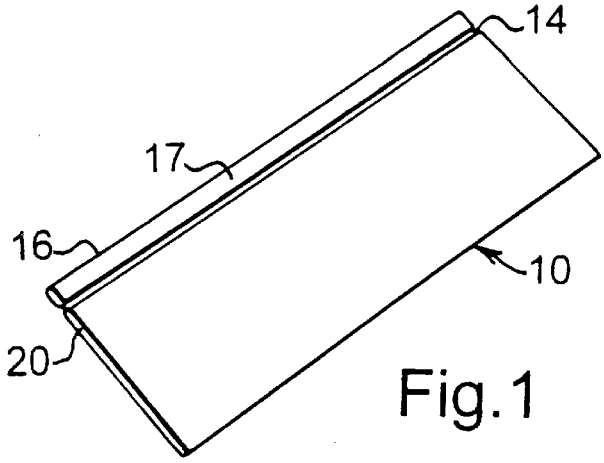
FIG. 1 shows a flattened tubular film package having a heat seal line defining a tear strip.

The invention comprises a tubular film package comprising a tubular film provided with a tear strip secured upon an outside surface of the film. The tear strip is defined by a longitudinal edge of the film and a heat seal joint provided in the film essentially parallel to the longitudinal edge. The film is further provided with at least one slit running from an end of the film to the heat seal line so that pulling of the strip away from the package commencing at the slit causes film to separate proximate the heat seal line thus opening the package. In one embodiment the package further comprises at least one tubular food casing strand encased therein so that the film encompasses the strand. In a further embodiment the strand has an exterior surface, an internal cylindrical bore and an interior bore surface and the tubular film is in contact with and covers both the exterior surface and internal bore surface of the strand and the tear strip extends along the length of the film along both the exterior and interior surfaces of the strand and so that ends of the tubular film are in contact and provided with a seal to completely enclose the strand while permitting access to a hole through the bore of the strand.

DETAILED DESCRIPTION OF THE INVENTION

The shirred tubular film to be packaged in accordance with the present invention may be of any suitable material, e.g. cellulose, collagen, polyolefin, and polyvinylidene chloride and may be unreinforced or reinforced e.g., with fiber randomly dispersed or in the form of a woven or non-woven web.

The tubular film may be used to package any suitable food product, e.g., sausages such as hot dogs, bolognas, salamis, fresh sausage, lunch meats etc., whole meats such as hams or turkey breast or other food product such as cheeses.

The plastic film encompassing the strands may be of any suitable heat sealable material, e.g., polyvinylidene chloride coated cellulose, polyvinylidene chloride, polyethylene and polypropylene. The plastic film may have shrink wrap characteristics, e.g., the strands may be placed in a tubular plastic film and the film shrunk over the strands to provide secure containment. The film may also have stretch characteristics so that it can be stretched over the strands and then relaxed to secure the strands.

In accordance with a preferred embodiment of the invention, the tubular film package may extend over the ends of the material to be packaged, e.g., food casing strands, and may be secured, e.g., clipped, glued, heat sealed or tied, over the ends of the material to provide a liquid tight package. The package ends are preferably heat sealed. It is however, to be understood that the quick opening feature of the invention may be used whether or not the package is sealed over the ends of the strands.

The tear strip to open the film is defined by a heat seal line essentially parallel to an edge of the tubular package and is usually from about 0.25 to about 1.5 inches wide.

For ease in gripping the tear strip and to provide a quick start for its removal, a slit or notch is provided in the packaging film commencing at an end of the film and terminating at the heat seal line weakened area. The tear strip defined by the heat seal line usually, but not essentially, extends the entire length of the strand.

The invention may be better understood by reference to the preferred embodiments illustrated in the drawings which are intended to exemplify but not limit the present invention.

The drawings show a tubular packaging material 10 in the form of a film overwrap to hold shirred (radially folded and axially compressed) food casing 12. In FIG. 1 the packaging material 10 is shown in a flattened form (flat stock). A heat seal joint 14 is formed at a distance of about 1 mm to about 100 mm from and essentially parallel to a longitudinal edge 16 of the tubular packaging material 10. The heat seal joint line 14 is formed by any suitable means, e.g. a rotary or bar sealer with a sealing width that forms a heat seal joint line of from about 0.5 to about 10 mm in width and preferably from about to about 1 to about 2 mm in width. The heat seal joint line 14 in conjunction with edge 16 defines a tear strip 17 having a width of from about 1 to about 100 mm and preferably from about 1 to about 25 mm. A slit 18 is formed in the tubular packaging material 10 which runs from an end 20 of the tubular film to heat seal joint line 14 so that pulling of the strip away from the package commencing at the slit 18 causes film to separate proximate the heat seal joint line thus opening the package. The slit may be formed by any suitable means, e.g. scissors or a knife. "Slit" as used herein is intended to include other weakened areas along a line, e.g. by a notch or by perforations. "Essentially parallel" , as used herein, means that the heat seal joint line deviates from being parallel to edge 16 by less than 15 degrees.

Figure 2:
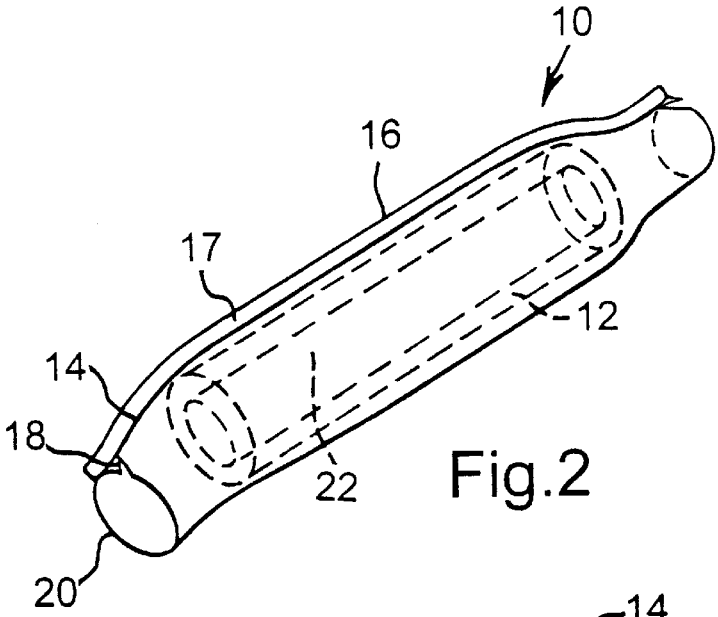
FIG. 2 shows the tubular film package of FIG. 1 encasing a fibrous shirred food casing strand.

In using the embodiment shown in FIG. 2, an operator of a food stuffing machine can simply load a strand packaged in the tubular film overwrap of the invention on a stuffing horn by placing the stuffing horn through bore 22. The tear strip 17 is then grabbed at the slit 18 and with a quick pulling motion pulled free to remove the overwrap.

Figure 3:
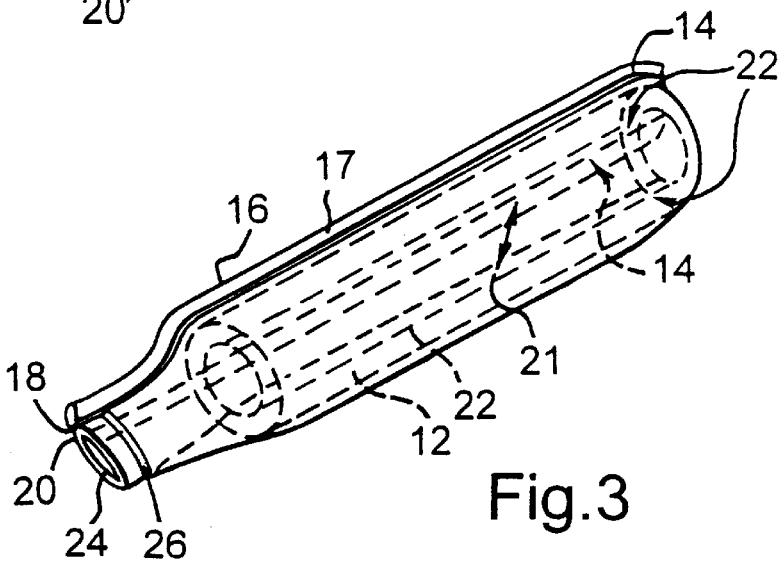
FIG. 3 shows a lengthened tubular film package of FIG. 1 encasing a fibrous shirred food casing stand having a portion of the package everted and passed through the bore of the strand and provided with an end seal.

In the alternative embodiment shown in FIG. 3, a strand 12 of shirred food casing is placed within a tubular package film 10 as above described; however, in the alternative embodiment, the tubular package film 10 is made in a length that is over twice the length of the strand so that upon placement of the strand 12 in the package film 10, a length 21 of package film overwrap 10 extending beyond the strand 12 may be inverted and drawn through the bore 22 of the strand to form an internal overwrap section covering the surface defining a bore 22 through the strand. The ends 20 and 24 of the tubular film package may then be sealed together by seal 26 to form an environmentally tight package over the strand. This package may then be placed in a carton for storage and shipment without the requirement of sealing the carton against the atmosphere or providing internal carton moisture.

In using the overwrap package described in the alternative embodiment, the package containing strand 12 is placed over a stuffing horn so that the internal overwrap section is located between the stuffing horn and an internal surface of the bore 22 of the strand. Before or after placement on the stuffing horn, the sea 26 is cut off. The tear strip 17 is then pulled along the strand 12. When the exterior portion of the overwrap is removed, pulling of the tear strip 17 is continued to cause tearing along the interior portion of the overwrap until the entire package is removed. This embodiment is unique in that it permits a strand to remain completely packaged until seconds before use.

What is claimed is:

1. A tubular film package comprising a tubular film provided with a tear strip secured upon an outside surface of the film, said tear strip being defined by a longitudinal edge of the film and a heat joint seal comprising a heat seal line provided in the film essentially parallel to the longitudinal edge, said film being further provided with at least one slit running from an end of the package along said heat seal line so that pulling of said strip away from the package commencing at the slit causes the film to separate proximate to and along the heat seal line thus opening the package.

2. The package of claim 1 further comprising at least one tubular food casing shirred strand contained therein wherein the tear strip defined by a longitudinal edge of the film and a heat seal joint extends along the length of the strand so that pulling of said strip away from the package, commencing at the slit, causes film to separate proximate the heat seal line thus opening the package and exposing the strands.

3. The package of claim 2 wherein said strip extends at least an entire length of the strand.

4. The package of claim 2 wherein the package contains a single food casing strand.

5. The package of claim 1 wherein the film comprises polyvinylidene chloride.

6. The package of claim 1 wherein the film comprises cellulose coated with a coating comprising polyvinylidene chloride.

7. The package of claim 1 wherein the film comprises a polyolefin.

8. A method for packaging a food casing shirred strand which comprises placing it within the package of claim 1.

9. The method of claim 8 wherein the package is evacuated and sealed.

10. A tubular film package comprising a tubular film provided with a tear strip secured upon an outside surface of the film, said tear strip being defined by a longitudinal edge of the film and a heat joint seal comprising a heat seal line provided in the film essentially parallel to the longitudinal edge, said film being further provided with at least one slit running from an end of the film to said heat seal line so that pulling of said strip away from the package commencing at the slit causes the film to separate proximate to and along the heat seal line thus opening the package, said package further comprising at least one tubular food casing shirred strand contained therein so that pulling of said strip away from the package, commencing at the slit, causes film to separate proximate the heat seal line thus opening the package and exposing the strands said strand having an exterior surface, an internal cylindrical bore and an interior bore surface and the tubular film is in contact with and covers both the exterior surface and internal bore surface of the strand and the tear strip extends along the length of the film along both the exterior and interior surfaces of the strand and so that ends of the tubular film are in contact and provided with a seal to completely enclose the strand while permitting access to a hole though the bore of the strand.

* * * * *